US008268090B2

(12) United States Patent
Rehm et al.

(10) Patent No.: US 8,268,090 B2
(45) Date of Patent: Sep. 18, 2012

(54) DOMESTIC APPLIANCE WITH PROGRAMMABLE CONTROL MODULE

(75) Inventors: Karlheinz Rehm, Trugenhofen (DE); Michael Rosenbauer, Reimlingen (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 884 days.

(21) Appl. No.: 10/583,699

(22) PCT Filed: Dec. 14, 2004

(86) PCT No.: PCT/EP2004/053454

§ 371 (c)(1),
(2), (4) Date: Mar. 6, 2009

(87) PCT Pub. No.: WO2005/064067

PCT Pub. Date: Jul. 14, 2005

(65) Prior Publication Data

US 2009/0165833 A1 Jul. 2, 2009

(30) Foreign Application Priority Data

Dec. 23, 2003 (DE) ..... 103 60 902
Nov. 25, 2004 (DE) ..... 10 2004 057 007

(51) Int. Cl.
*D06F 33/02* (2006.01)
*B08B 3/04* (2006.01)

(52) U.S. Cl. ..... 134/57 D; 134/56 D; 134/58 D; 68/12.23

(58) Field of Classification Search ..... 134/57 D, 134/58 D, 56 D; 68/12.23
See application file for complete search history.

(56) References Cited

U.S. PATENT DOCUMENTS

| | | | | |
|---|---|---|---|---|
| 5,619,614 | A | 4/1997 | Payne et al. | |
| 5,915,851 | A * | 6/1999 | Wattrick et al. | 4/619 |
| 5,917,690 | A * | 6/1999 | Anderson | 361/87 |
| 2002/0131243 | A1 * | 9/2002 | Harrison et al. | 361/728 |
| 2003/0028258 | A1 | 2/2003 | Peterson | |
| 2003/0205954 | A1 * | 11/2003 | Oyler et al. | 312/311 |
| 2005/0009216 | A1 | 1/2005 | Hauser et al. | |

FOREIGN PATENT DOCUMENTS

| | | |
|---|---|---|
| DE | 08 14 447 | 9/1951 |
| DE | 197 57 305 | 6/1999 |
| DE | 103 07 756 | 9/2004 |
| WO | WO 98/30941 | 7/1998 |
| WO | WO 01/34185 | 5/2001 |
| WO | WO 02/12610 | 2/2002 |

OTHER PUBLICATIONS

International Search Report PCT/EP2004/053454, Jul. 2005.

* cited by examiner

*Primary Examiner* — Michael Barr
*Assistant Examiner* — Benjamin Osterhout
(74) *Attorney, Agent, or Firm* — James E. Howard; Andre Pallapies

(57) ABSTRACT

A dishwasher, the program control of which permits the installation of the program control module in the dishwasher, a subsequent programming of the program control and a change to the rinse program sequence pre-programmed in the program control. An electronic program control for the control of rinsing program sequences is provided with a programmable control module and includes an interface, for the external programming of at least one rinsing program sequence, carried out by the program control, which may be directly contacted from outside the dishwasher. By integrating an interface that may be directly contacted from outside the dishwasher, for the external programming of rinsing program sequences in the control module of the program control, the program control can be installed in the dishwasher without pre-programming and programmed in a final step, or after the production of the dishwasher.

21 Claims, 2 Drawing Sheets

DOMESTIC APPLIANCE WITH PROGRAMMABLE CONTROL MODULE

The present invention relates to a household appliance, especially a washing machine or dishwasher, comprising an electronic program controller for controlling rinsing program sequences with a programmable control module which has an interface for programming at least one rinsing program sequence that can be carried out by the program controller.

In household appliances, especially in a dishwasher, one or more rinsing processes using heated rinsing liquid are usually carried out in the course of the rinsing operation in order to clean the items to be washed that are located in the dishwasher. After the last rinsing process, a clear rinsing phase is usually carried out, followed by a drying process to dry the items to be washed. These and many other operating modes are combined in specific rinsing program sequences matched to the type and quantity of items to be washed. The rinsing program sequences are usually controlled by an electronic program controller wherein a plurality of rinsing program sequences are usually stored in the electronic components thereof.

These program controllers are frequently obtained by the dishwasher manufacturer via suppliers in the form of program control modules in which the desired rinsing program sequences are already pre-programmed. After installing the program control module in the dishwasher, it is no longer possible to subsequently program the program controller or change the rinsing program sequences pre-programmed in the program controller or this can only done with considerable effort, for example, it is necessary to dismantle significant parts of the dishwasher or the program controller must be removed, in particular with considerable assembly effort, because the program controller is located in the interior of the household appliance.

It is the object of the present invention to provide a dishwasher whose program controller can be programmed even after installing the program control module in the dishwasher and rinsing program sequences pre-programmed in the program controller can be varied subsequently in a simple and inexpensive manner.

This object is achieved by the dishwasher according to the invention having the features according to claim 1. Advantageous further developments of the present invention are characterised in the dependent claims 2 to 12.

In the household appliance according to the invention, especially a washing machine or dishwasher, an electronic program controller is provided for controlling rinsing program sequences comprising a programmable control module which has an interface for programming at least one rinsing program sequence which can be executed by the program controller, wherein programming can be carried out without dismantling parts of the household appliance. Dismantling parts of the household appliance is understood within the scope of this patent application as important parts, e.g. side or rear walls. For example, in the case of an interface accessible from outside on the outer walls, it may be necessary to dismantle a smaller cover of the interface, e.g. a plug protector flap.

The interface can preferably be contacted directly from outside the dishwasher, i.e. the interface is accessible from outside without dismantling important parts of the household appliance.

As a result of integrating an interface which can be contacted directly from outside the dishwasher, for external programming of rinsing program sequences on the control module of the program controller according to the present invention, the program controller can be installed in the household appliance without pre-programming and programmed in one of the final steps or after production of the dishwasher has been completed. The direct contacting of the interface of the programmable control module means in this context that the interface can also be contacted from outside the household appliance after it has been installed without structural modifications any substantial assembly effort being required for this purpose on the household appliance. As a result, the program control module can be supplied initially as an un-programmed controller from the supplier and the rinsing program sequences can be completely installed during or after assembly of the household appliance without needing to make structural modifications to the household appliance. Since the interface of the programmable control module can be contacted directly, according to the present invention it is also possible for the program control module to be pre-programmed by the supplier in accordance with the customer's wishes. The number of variants of household appliances, especially dishwashers is therefore reduced during manufacture since different rinsing program sequences can be programmed subsequently on the programmable control module and only so-called hardware variants need be planned for the final assembly of the dishwasher.

The household appliance according to the invention thus has the advantage that the program control can still be programmed after the production process has been completed or rinsing program sequences pre-programmed in the program control can be altered, exchanged or extended after the production process. The preparation complexity in final assembly and the assembly effort overall is thereby reduced and the product flexibility is increased. The programmable control module with the interface which can be contacted directly from outside the household appliance also allows rinsing programs in particular to be rapidly and flexibly programmed or updated.

In a preferred embodiment of the present invention, the interface of the programmable control module comprises a number of contacts for external programming of the control module, which are preferably embodied as plug connections. However, the interface of the programmable control module can also be embodied as an infrared interface or as a wireless radio connection. Each of these types of interface allows the control module to be programmed simply before, during or after production of the household appliance; however, programming sequences, especially rinsing program sequences, already provided in the control module can also be re-programmed or extended via the interface of the program control after starting up the household appliance.

In this case, it is particularly advantageous if the programmable control module comprises electronic components required for the program control and preferably at least one microprocessor and/or memory means. The memory means can be used to store rinsing program sequences which can be executed by the program controller, for example, which had previously been transmitted for programming the program control via the interface. The microprocessor is, for example, capable of executing rinsing program sequences stored in the programmable control module and delivering corresponding signals to components of the household appliance involved in the rinsing process. Additionally or alternatively, the microprocessor can contain an operating system for programming the control module.

Advantageously, the programmable control module also comprises a power supply input filter for filtering higher frequencies. The power supply input filter is used to suppress interference and for the electromagnetic compatibility of the household appliance. A particularly efficient effect can be achieved if the power supply input filter filters out frequencies in the range of 150 kHz to 30 MHz or from 30 MHz to 300 MHz. As a result, almost all the electronic components required for the electrical connection of the program control can be accommodated in the programmable control module which also makes it easier to check the electromagnetic compatibility (EMC matching) of the dishwasher.

The electrical power supply in household appliances is usually provided by a mains lead via an electrical connection designed for higher current intensities. For this purpose, the manufacturer usually fits household appliances with a mains lead which is fixedly mounted at the appliance. In order to connect the appliance to the power supply, the plug of the mains lead merely needs to be plugged into the socket. However, the fixed connection of the mains lead at the appliance has the disadvantage that for different power supply connectors in different countries, for example, a corresponding mains lead must be mounted externally of the appliance. In a further preferred embodiment of the present invention, the programmable control module comprises a primary power plug connector for the power supply of the programmable control module and the household appliance. These primary power plug connectors can be used to connect a mains lead which has a plug connector constructed complementarily to the primary power plug connector on the appliance side and a plug connector suitable for the mains connection on the mains side. As a result, the dishwasher according to the invention can have the suitable mains lead attached after production or it can be supplied without a fixed mains lead and the suitable mains lead can be added, for example, by the appropriate national distribution centre.

Programming the control module or functional testing after installing the control module in the dishwasher according to the invention is especially facilitated if the primary power plug connector and the interface for external programming of the programmable control module can be contacted via a combination plug connector. The combination plug connector comprises both the complementarily constructed counterpart to the primary power plug connector and also the complementarily constructed counterpart to the interface. Since both the complementarily constructed counterpart to the primary power plug connector and also the complementarily constructed counterpart to the interface are combined to form a unit in the combination plug connector, contact with the programmable control module can be made particularly easily and practically in one hand movement.

Appropriately, an electrical connection is provided for the electrical connection of the programmable control module with the dishwasher, which is preferably embodied as a group plug with a plurality of electrical contacts. In this way, the electrical connection between the programmable control module and the dishwasher can be made using only one plug connector, which makes it easier to assemble or exchange the control module.

The control module according to the invention comprises at least one board whereon electronic components required for the program controller are arranged. The board has an electrical connection to make the connection between the program controller and the dishwasher. For this purpose, a section at the edge of the board is preferably embodied as an electrical connection with a number of electrical contacts. During assembly, the programmable control module can be inserted with this section at the edge of the board quickly and easily into a complementarily constructed slot in the household appliance provided for this purpose.

The interface for programming the program controller and the primary power plug connector on the programmable control module are advantageously integrated such that their placement allows contact from outside the household appliance. For this purpose, the programmable control module is preferably installed in the bottom tray of the dishwasher and is arranged so that the interface for programming the control module can be contacted through the rear wall of the bottom tray. During the final functional testing after the production process, the household appliance can thus be supplied with power via the primary power plug connector in the programmable control module and programmed via contacting the interface.

The present invention is explained in detail hereinafter using preferred exemplary embodiments with reference to the appended drawings. In the figures.

Figure 1:
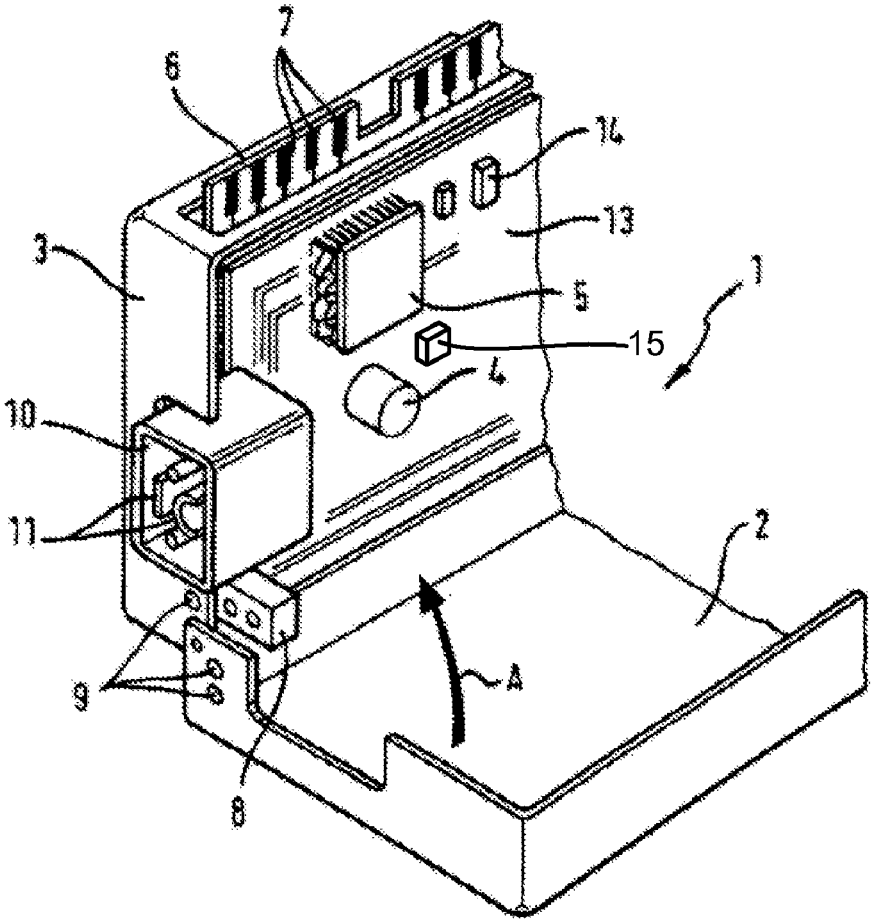
FIG. 1 is a perspective view of a programmable control module for program control of a dishwasher according to a preferred embodiment of the present invention.

The programmable control module shown in FIG. 1 is used for programming and control of rinsing program sequences of a dishwasher according to the invention (not shown). In the preferred embodiment of the invention shown in FIG. 1, the programmable control module 1 is accommodated in a housing comprising two hinged halves 2 and 3. FIG. 1 shows the housing halves 2 and 3 in the folded down position so that the components of the programmable control module are visible. To close the housing the two housing halves 2, 3 are folded together with a pivoting movement in the direction of the arrow A.

The programmable control module 1 comprises a board 13 on which the electronic components 4 required for program control are arranged. The board 13 has an electrical connection 6 to make the connection between the programmable control module 1 and the dishwasher. For this purpose a section at the edge of the board 13 is embodied as an electrical connection 6 with a plurality of electrical contacts 7. With this section at the edge of the board 13 the programmable control module can be inserted into a complementarily constructed slot in the dishwasher provided for this purpose.

The programmable control module 1 has an interface 8 with a number of electrical contacts used for external programming of the control module. In the embodiment shown in the figures, the electrical contacts of the interface 8 are embodied as plug connections which can be contacted directly from outside the dishwasher via appropriate plug connectors for the external programming of the control module 1. Since the interface 8 is contacted directly from outside the dishwasher, external programming of the control module 1 can easily be carried out before, during or after manufacture of the dishwasher. The interface 8 of the programmable control module can also be contacted from outside the dishwasher without needing to make significant structural modifications to the dishwasher.

The electronic components 4 of the programmable control module required for the program controller comprise a microprocessor 5 and electronic memory means 14 which stores rinsing program sequences which can be executed by the program controller, which had previously been transmitted for programming the program controller via the interface 8. The microprocessor 5 is capable of executing rinsing program sequences stored in the electronic memory means 14 and delivering corresponding signals to components of the dishwasher involved in the rinsing process. Additionally, the microprocessor contains an operating system for programming the control module. A power supply input filter 15 for high frequencies is arranged on the board 13 of the programmable control module 1 to suppress interference of the dishwasher.

The embodiment of the programmable control module 1 shown in the figures is fitted with a primary power plug connector 10 for the power supply of the programmable control module and the household appliance. Since only specific power supply cables for higher current intensities are permissible for operation of dishwashers, the primary power plug connector 10 is provided with protruding pins 11 which can only be used to connect a specific means lead which meets the requirements which has a plug connector constructed complementarily to the primary power plug connector 10 and the protruding pins 11 on the appliance side and a plug connector suitable for the mains connection on the mains side.

In a preferred embodiment, the interface for programming the program controller and the primary power plug connector 10 on the programmable control module 1 are integrated in such a manner that contact can be made from outside the dishwasher. For this purpose, the programmable control module 1 is installed in the bottom tray of the dishwasher and is arranged so that the interface for programming the control module can be contacted through the rear wall 12 of the bottom tray.

Figure 2:
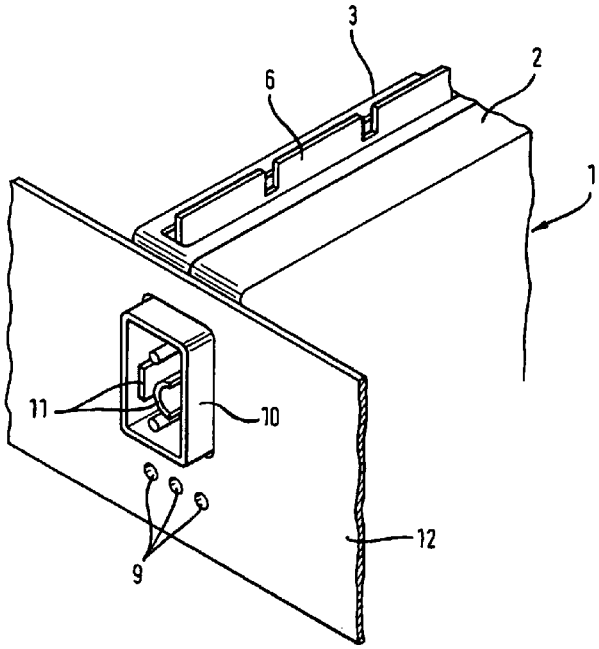
FIG. 2 is a perspective detailed view of the programmable control module shown in FIG. 1 when installed.

FIG. 2 shows a perspective view of the programmable control module 1 shown in FIG. 1, installed in the dishwasher. When installed, the housing halves 2 and 3 are closed and the primary power plug connector 10 projects through an opening in a housing wall 12 of the dishwasher so that it can be contacted from outside the housing wall 12. The housing wall 12 comprises the rear wall of the bottom tray of the dishwasher. In addition to the opening for the primary power plug connector 10, the housing wall 12 also contains openings 9 through which the interface 8 located therebehind can be contacted from outside the housing wall 12 via corresponding plug connectors for external programming of the control module 1. In this way, the control module 1 can be programmed externally via the interface 8 after manufacture of the dishwasher has been completed or rinsing program sequences already contained in the control module 1 can be reprogrammed or extended via the interface 8 of the program controller after starting up the dishwasher.

Since the programmable control module 1 can be contacted externally, the dishwasher can be supplied with power via the primary power plug connector during final functional testing after the production process and the programmable control module 1 can be tested or programmed by contacting the interface 8.

REFERENCE LIST

1 Programmable control module
2 First housing half of programmable control module 1
3 Second housing half of programmable control module 1
4 Electronic components of programmable control module 1
5 Microprocessor
6 Group plug of programmable control module 1
7 Electrical contacts of group plug 6
8 Interface of programmable control module 1
9 Openings in housing of programmable control module 1
10 Primary power plug connector
11 Webs in primary power plug connector
12 Rear wall of dishwasher
13 Board of programmable control module 1
1. Electronic Memory Means
A Direction of pivoting movement for closing housing halves 2 and 3

The invention claimed is:

1. A household washing appliance, comprising:
an electronic program controller for controlling rinsing program sequences, the electronic program controller including a programmable control module having an interface for programming at least one rinsing program sequence that can be executed by the program controller and the electronic program controller being configured such that programming thereof can be carried out without dismantling parts of the household appliance,
wherein the programmable control module contains an operating system that programs the control module.

2. The household appliance according to claim 1, wherein the household appliance is a dishwasher and the interface can be contacted directly from outside the dishwasher.

3. The household appliance according to claim 1, wherein the interface of the programmable control module includes a number of contacts for external programming of the control module, the contact being configured as a selected one of plug connections and non-plug connections.

4. The household appliance according to claim 1, wherein the interface of the programmable control module is configured as a selected one of an infrared interface and a wireless radio connection.

5. The household appliance according to claim 1, wherein the programmable control module includes electronic components including at least one microprocessor and/or memory means.

6. The household appliance according to claim 1, wherein the programmable control module includes a power supply input filter for filtering out frequencies in a predetermined range.

7. The household appliance according to claim 6, wherein the power supply input filter is for filtering out frequencies in the range of 150 kHz to 30 MHz or from 30 MHz to 300 MHz.

8. The household appliance according to claim 1, wherein the programmable control module includes a primary power plug connector for the power supply of the programmable control module and the appliance.

9. The household appliance according to claim 8, wherein the primary power plug connector is positioned adjacent to the interface for external programming of the programmable control module so that the primary power plug connector and the interface for external programming of the programmable control module are adapted to be contacted via a combination plug connector in which both a complementarily constructed counterpart to the primary power plug connector and also a complementarily constructed counterpart to the interface are combined to form a unit.

10. The household appliance according to claim 1, wherein a group plug with a plurality of contacts is provided for the electrical connection of the programmable control module with the appliance.

11. The household appliance according to claim 1, wherein the programmable control module comprises at least one board whereon electronic components required for the program controller are arranged and which can be inserted with an electrical connection into a complementarily constructed slot in the appliance provided for this purpose, wherein a section at the edge of the board is embodied as an electrical connection with a number of electrical contacts.

12. The household appliance according to claim 1, wherein the household appliance is a dishwasher, the programmable control module is located in a bottom tray of the dishwasher and the interface for programming the control module can be contacted from outside the dishwasher.

13. The household appliance according to claim 1, wherein the programmable control module is located adjacent to the interface, and the programmable control module and the interface are located at a rear wall of a bottom tray of the washing appliance.

14. The household appliance according to claim 1, wherein the interface for programming is configured to be connected to an external device that operates with the programmable control module to program the programmable control module.

15. A household washing appliance, comprising:

an electronic program controller for controlling program sequences of the washing appliance, the electronic program controller including a programmable control module having an interface for programming at least one program sequence that can be executed by the program controller, wherein the electronic program controller is configured such that programming thereof can be carried out without dismantling parts of the washing appliance, the programmable control module is located adjacent to the interface, the programmable control module and the interface are located at a rear wall of the washing appliance, and the programmable control module contains an operating system that programs the control module.

16. The household appliance according to claim 15, wherein the household washing appliance is a dishwasher.

17. The household appliance according to claim 16, wherein the programmable control module and the interface are located at a rear wall of a bottom tray of the dishwasher.

18. The household appliance according to claim 15, wherein the interface for programming is configured to be connected to an external device that operates with the programmable control module to program the programmable control module.

19. A method of programming a household washing appliance, the washing appliance having an electronic program controller for controlling program sequences of the washing appliance, the electronic program controller including a programmable control module having an interface for programming at least one program sequence that can be executed by the program controller, wherein the electronic program controller is configured such that programming thereof can be carried out without dismantling parts of the washing appliance, the programmable control module is located adjacent to the interface, the programmable control module and the interface are located at a rear wall of the washing appliance, and the programmable control module contains an operating system that programs the control module, the method comprising:

accessing the interface without dismantling parts of the washing appliance; and transmitting the at least one program sequence into the programmable control module through the interface.

20. The method according to claim 19, wherein the at least one program sequence transmitted into the programmable control module through the interface is a rinsing program sequence.

21. The method according to claim 19, wherein the at least one program sequence is transmitted from a source external to the household washing appliance into the programmable control module through the interface.

* * * * *